US005171154A

United States Patent [19]

Casciotti et al.

[11] Patent Number: 5,171,154

[45] Date of Patent: Dec. 15, 1992

[54] HIGH DENSITY BACKPLANE CONNECTOR

[75] Inventors: Albert Casciotti, Hershey, Pa.; Ronald A. Dery; David J. Goetzinger, both of Winston-Salem, N.C.

[73] Assignee: AMP Incorporated, Harrisburg, Pa.

[21] Appl. No.: 788,703

[22] Filed: Nov. 6, 1991

[51] Int. Cl.[5] ..... H01R 9/09

[52] U.S. Cl. ..... 439/67; 439/62; 439/260; 439/465; 439/493; 439/637

[58] Field of Search ..... 439/65, 67, 493, 62, 439/64, 77, 159, 260, 263, 630, 632, 636, 637, 465

[56] References Cited

U.S. PATENT DOCUMENTS

| | | | |
|---|---|---|---|
| 3,609,463 | 9/1971 | Laboue | 439/65 |
| 4,087,148 | 5/1978 | Bäuerle | 439/260 |
| 4,552,420 | 11/1985 | Eigenbrode | 439/67 |
| 4,776,805 | 10/1988 | Brown et al. | 439/637 |
| 4,907,975 | 3/1990 | Dranchak et al. | 439/493 |
| 4,969,824 | 11/1990 | Casciotti | 439/62 |
| 5,092,781 | 3/1992 | Casciotti et al. | 439/62 |
| 5,098,309 | 3/1992 | Deak et al. | 439/260 |

FOREIGN PATENT DOCUMENTS

| | | | |
|---|---|---|---|
| 964742 | 3/1975 | Canada | 439/493 |
| 48352 | 12/1972 | Japan | 439/637 |

*Primary Examiner*—Larry I. Schwartz
*Assistant Examiner*—Kevin J. Carroll

[57] ABSTRACT

A high density connector (10) for electrically interconnecting conductive paths (14, 84) on close centers between circuit boards such as those of a backpanel (82) and daughter cards (12), includes a clamping mechanism (18, 20) bolted first to a daughter card and then to a backpanel to compress springs (46, 48, 50) held by the mechanism driving flat flexible circuits (52) having contacts (68, 70) on close centers to engage board circuit paths, where the mechanism (18, 20) is rigid and includes spring driven clamps (42) to straighten the daughter card and strain relief the interconnection area. The flexible circuit contacts (68, 70) are offset relative to the springs (48, 50) bearing area to provide a contact wipe of the contact path interconnection.

11 Claims, 8 Drawing Sheets

12
14
14
20
46
72
40
42
72
18
76
78
70
80
15
66
48
58
52
62
64
68
54
84
82
86
86
84
94
94
92

12
14
14
20
18
24
38
40
42
46
44
80
76
32
78
30
50
32
34
34
48
84
86
86
84
82
94
92
94

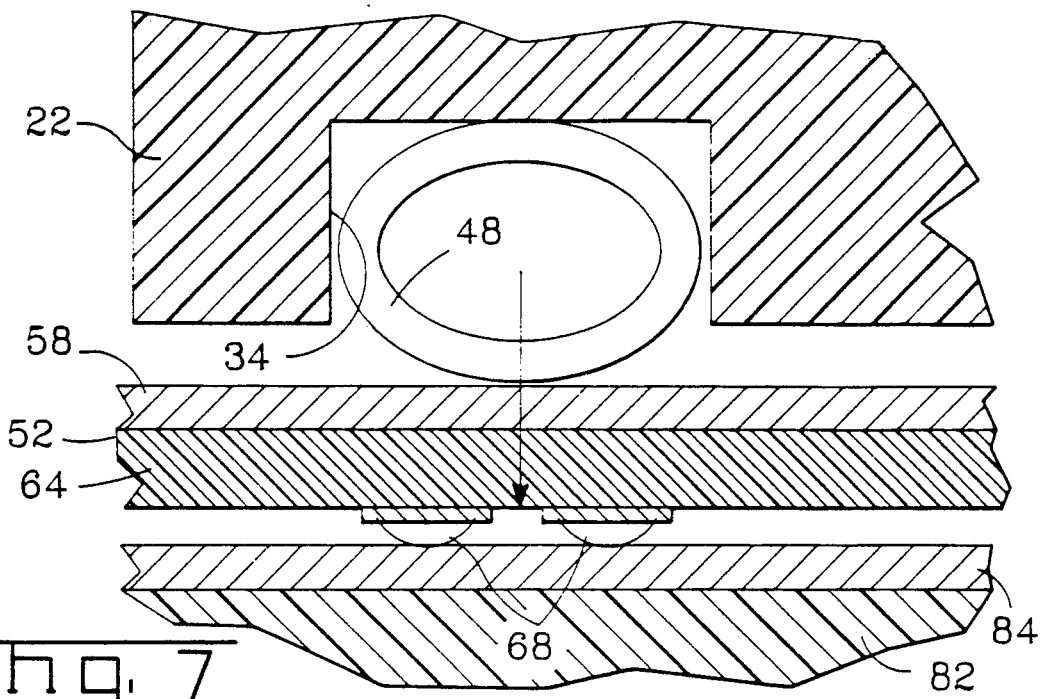
Fig. 7
Fig. 8
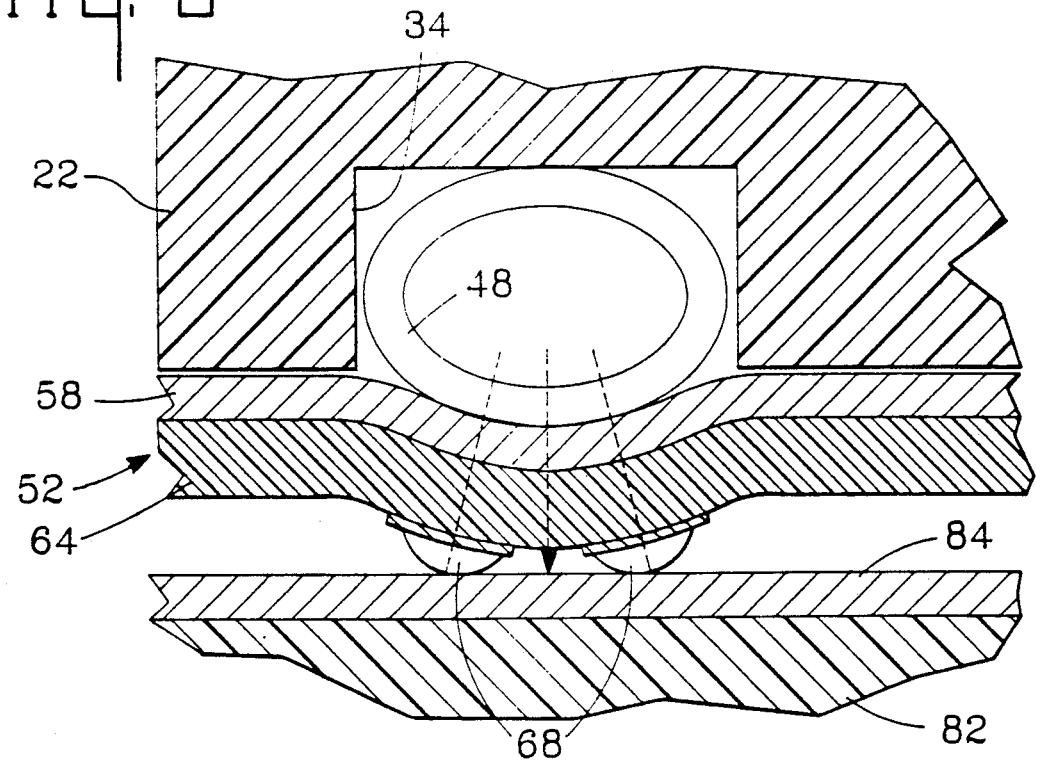

HIGH DENSITY BACKPLANE CONNECTOR

This invention relates to a high density connector for electrically interconnecting conductive paths which are on close centers extending over a broad area between circuit boards.

BACKGROUND OF THE INVENTION

The architecture of complex computers, business machines, communication systems has largely developed around the use of a backplane, or mother board, which interconnects multiple daughter boards or cards carrying functioning components designed to define a host of memory and logic functions and the necessary electrical components to effect a signal generation and transmission. Various circuit paths on backpanel and daughter card are interconnected, typically through connectors which engage such circuit paths mechanically with a normal force between contact surfaces sufficient to establish a stable, low-resistance electrical path. Increasing circuit complexity has led to an increase in contact density to a point where hundreds of circuit paths must be interconnected between a given daughter card and a backplane, there being numerous daughter cards associated with a given backplane. This, in turn, has created mechanical problems in that the cumulative normal forces required to effect such an interconnection sometimes exceed 50 or 80 lbs. per card, per side of the card, and all are on extremely close centers, frequently in multiple rows on a given side of a card to require extremely accurate dimensions of the boards, connectors, contacts and the like. A still further problem has to do with the surface finishes of the contacts of connectors which may be contaminated in inventory or in handling and cause a variability in resistance between paths which, in the presence of high speed signal pulses transmitted therethrough alter to the resistance and impedance of the circuit paths to a detriment of circuit function.

U.S. Pat. No. 4,969,824 is drawn to a high density connector which utilizes a type of spring known as a canted coil spring made coextensive with the arrays of contacts to be interconnected between backpanel and daughter cards as the main force driving element. A further development extends the use of the canted coil spring to include a spring made of shape memory alloy and provides a rigid tubular bar structure adapted to hold such springs in engagement to effect the interconnection of contacts. This Application also includes a flexible film strip wrapped around the tubular rigid bar so as to hold the contacts in place and provide an even pressure from the springs against such contacts.

U.S. Pat. No. 5,092,781 adds features allowing for an operation of canted coil springs made of shape memory alloy to provide a displacement allowing for either a low-insertion withdrawal force or a zero insertion force, with respect to daughter card and backpanels. U.S. Pat. No. 5,098,309 similarly employs rigid bars, thin flexible films carrying contacts in circuits, and additionally provides a mechanism wiping and backwiping the contacts through a particular cam motor structure.

In each of these cases, the rigid bar structures are applied to the backplane with the daughter card fitted between such structures, and the structures operated through mechanisms to effect a clamping together to provide an interconnection between the circuit paths of the backplane and various daughter cards. Work with these types of interconnection systems has uncovered a number of problems, including the need to provide extremely closely dimensioned board surfaces, including the contacts thereon interconnecting the board circuit paths in order to assure an adequate mating of the large numbers of closely spaced contacts required. Problems with the straightness of boards, particularly daughter card boards, and with damage to such boards caused by the relatively high forces involved, have been uncovered.

Accordingly, it is an object of the present invention to provide a high density interconnection connector which assures a proper dimension of the area of interconnection between circuit boards. It is still a further object to provide a connector which is applied to daughter cards to strain relief and straighten such cards to assure dimensional compatibility relative to interconnection with a backpanel board. It is yet a further object of the invention to provide a connector for providing an interconnection between contacts on boards which are on close centers in multiple rows extending over an area of the boards and including wipe of the contacts.

SUMMARY OF THE INVENTION

The present invention achieves the foregoing objects through the provision of a high density connector for interconnecting conductive paths on close centers between circuit boards such as those of backpanel and daughter cards through a clamping mechanism which may be bolted to a daughter card on both sides and/or to a backpanel to compress springs held by the mechanism which drive flat flexible circuits. The circuits include contacts on close centers to engage the contact paths of the circuits on daughter and backpanel boards. The clamping mechanism includes rigid bars which have a set of grooves on the sides which face the daughter card and the backpanel. The grooves are made to contain spring elements, such as canted coil springs, extending along the length of the bars. A thin, flat, flexible circuit is provided having contacts on close centers to engage the various board contacts with the contacts being spaced a two contacts for each interconnection, so as to be driven provide a slight wiping action by the flexing of the circuit under pressure of the springs positioned to engage the circuit between the spaced apart contacts.

Each of the bars further includes a further groove extending along the length and coextensive with the daughter card having a spring element therein driving a clamp to clamp against the daughter card in board of the contact area. This clamping effectively strain relieves the daughter card interconnection area and as well, straightens the card to maintain the contact paths thereon in a plane assuring an interconnection of such paths to the contacts of the flexible circuit and therefore to the contacts engaging the backplane conductive paths. The rigid bars of the clamping mechanism are bolted through bolts passed through the bars, through the daughter card, and flexible circuit, which results in the bars being clamped together effecting normal forces through the springs carried in the grooves thereof against the flexible circuit and against the circuit paths of the board. Bolts may be passed through the bars and attached to the daughter board, which is then held compressively against the backpanel by conventional cam locks. Alternately, bolts are passed through the bars as attached to the daughter card and made to extend through the backpanel and a rigid further bar placed beneath the backpanel with suitable means, such as nuts, tightened, to draw the daughter card and the bars thereof, as clamped, down against the upper surface of the backpanel, compressing the flexible circuit and the force generating springs carried on the lower surface of the bars to effect an interconnection of the circuit paths of daughter card and backpanel.

IN THE DRAWINGS

FIG. 3 is a perspective view showing the connector of the invention as applied to a daughter card positioned above a backpanel prior to installation.

FIG. 8 is a view of the elements of FIG. 7 following compression.

DETAILED DESCRIPTION OF THE INVENTION

Figure 1:
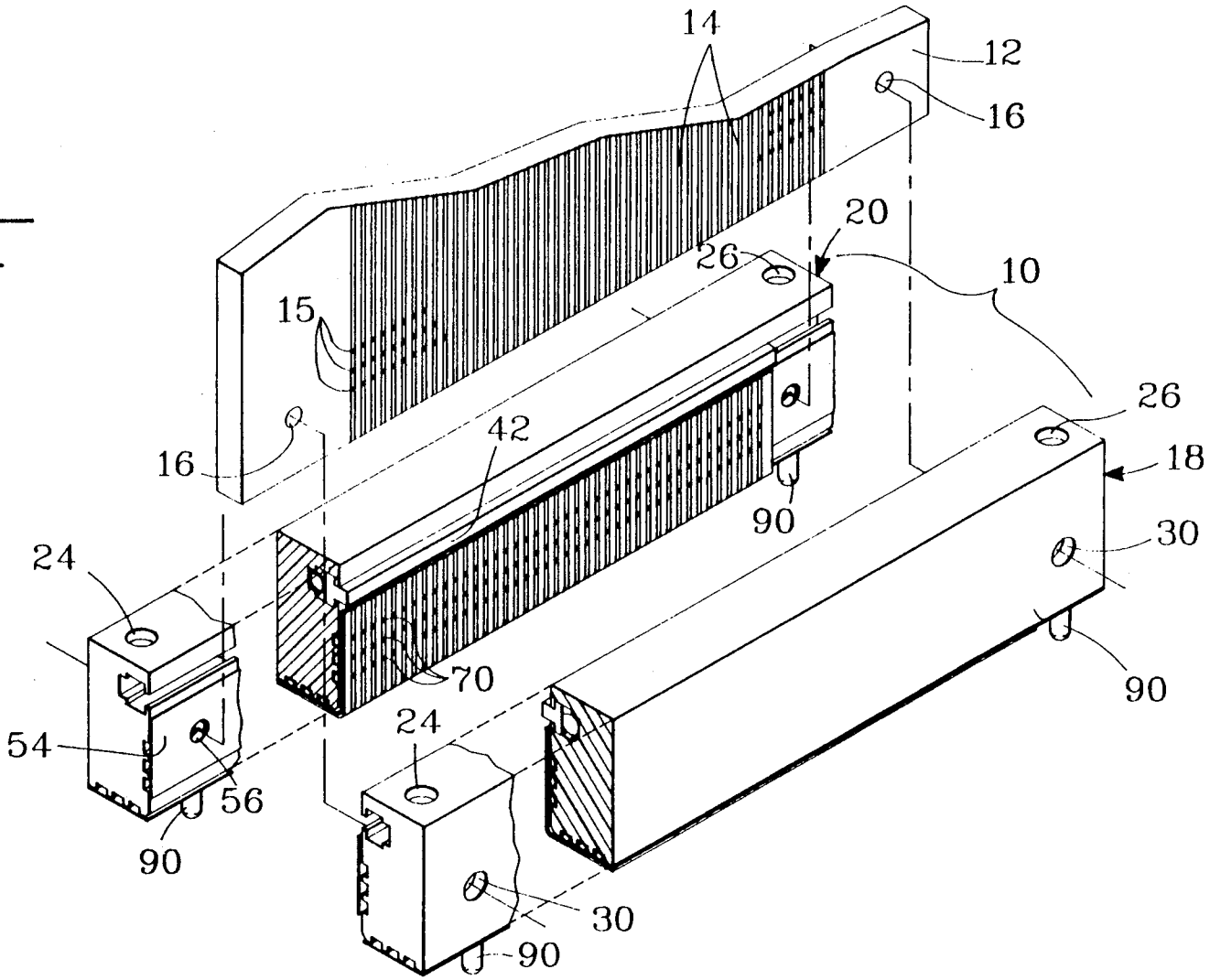
FIG. 1 is a perspective showing, in an exploded view, a daughter card and the connector in accordance with the invention, prior to assembly.

Referring now to FIG. 1, illustrating one embodiment thereof, the invention connector 10 is shown relative to a daughter card 12 preparatory to insertion of the card 12 and assembly of the connector. The daughter card 12 may be seen to include an array of conductive paths 14 on the forward surface thereof, it being understood that a similar array of conductive paths, not shown, would be on the reverse side of the card. Also not shown, but understood to be possible in at least one version of the card, are conductive paths buried within the body of the card, the paths 14 being only illustrative terminating to paths, including those on the surface of the card and those within the body of the card. Contacts 15 are arranged in three rows in the illustrative embodiment in FIG. 1 forming an interconnection area extending across the area of the card. It is to be understood that the contacts 15 attach to individual circuits of card 12. U.S. Pat. No. 4,969,824 shows a variety of circuit paths in relation to a film strip and a board, and reference is hereby made to such patent, which is incorporated herein by such reference.

Figure 2:
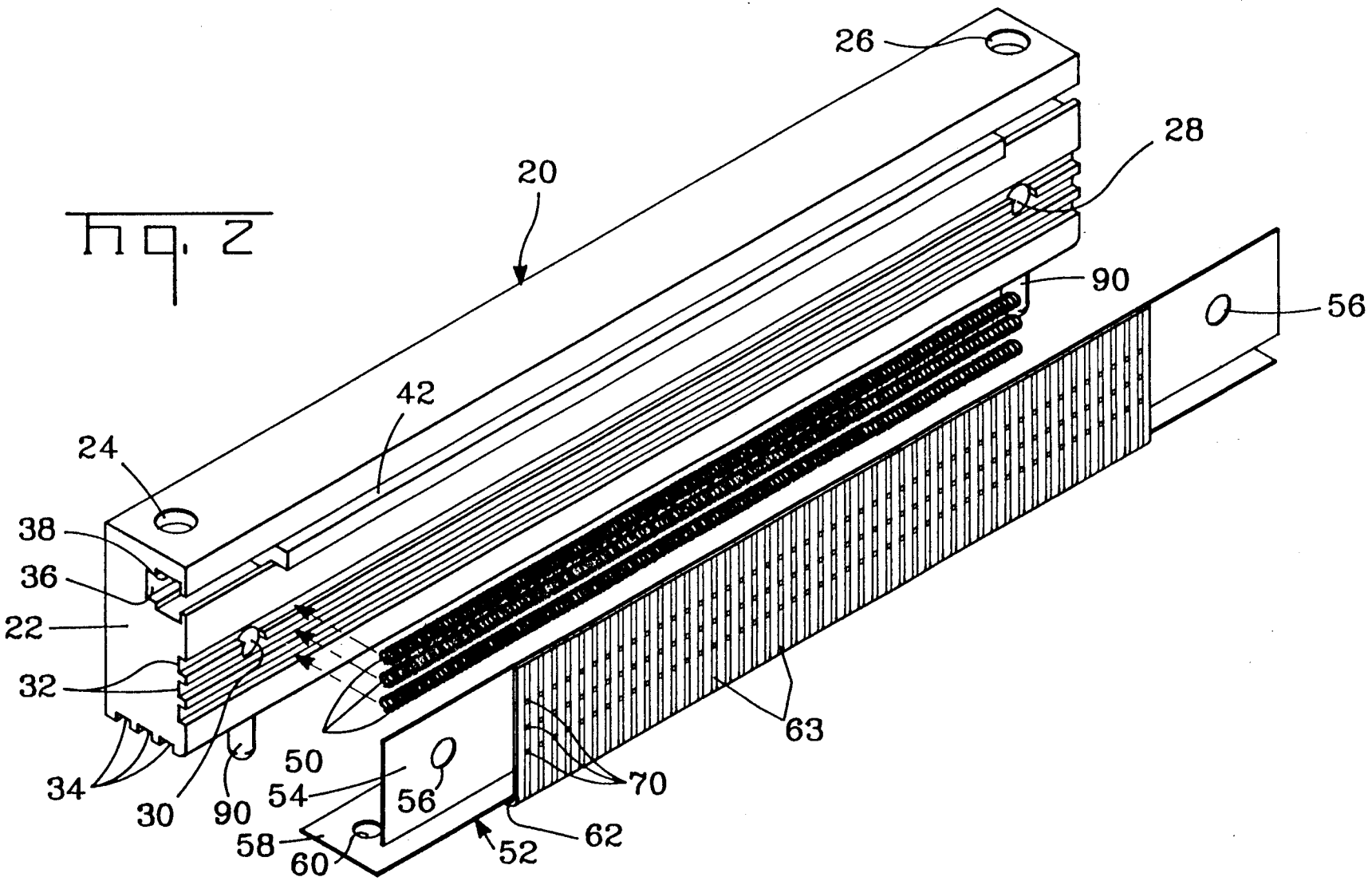
FIG. 2 is a view, enlarged, of the left-hand portion of the connector shown in FIG. 1, further exploded to include bar, contact driving springs, and flexible circuit.
Figure 4:
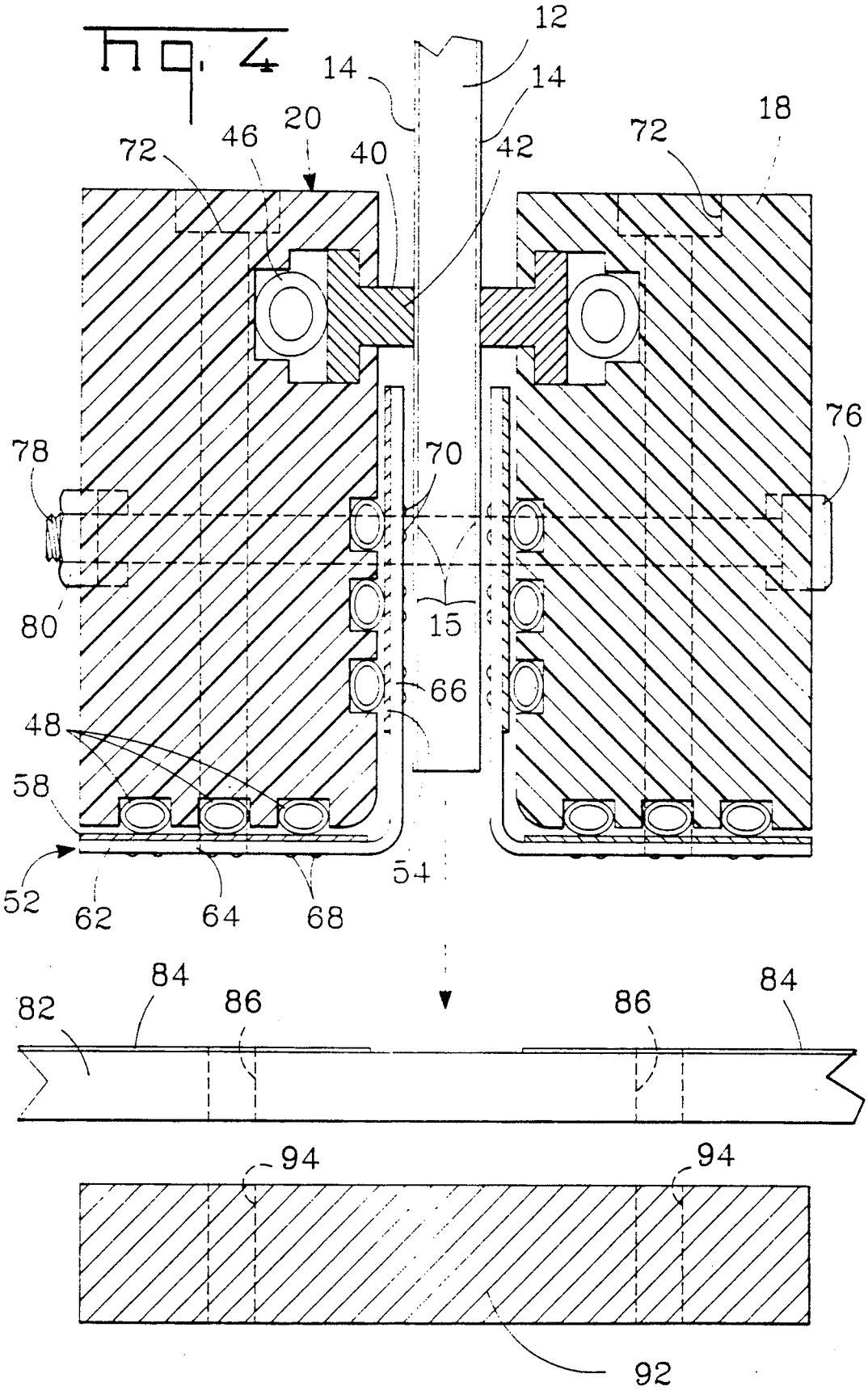
FIG. 4 is a side, elevational and partially sectioned view of the connector as shown in FIG. 3, prior to a clamping of the connector against the daughter card and positioned above the backpanel board.
Figure 5:
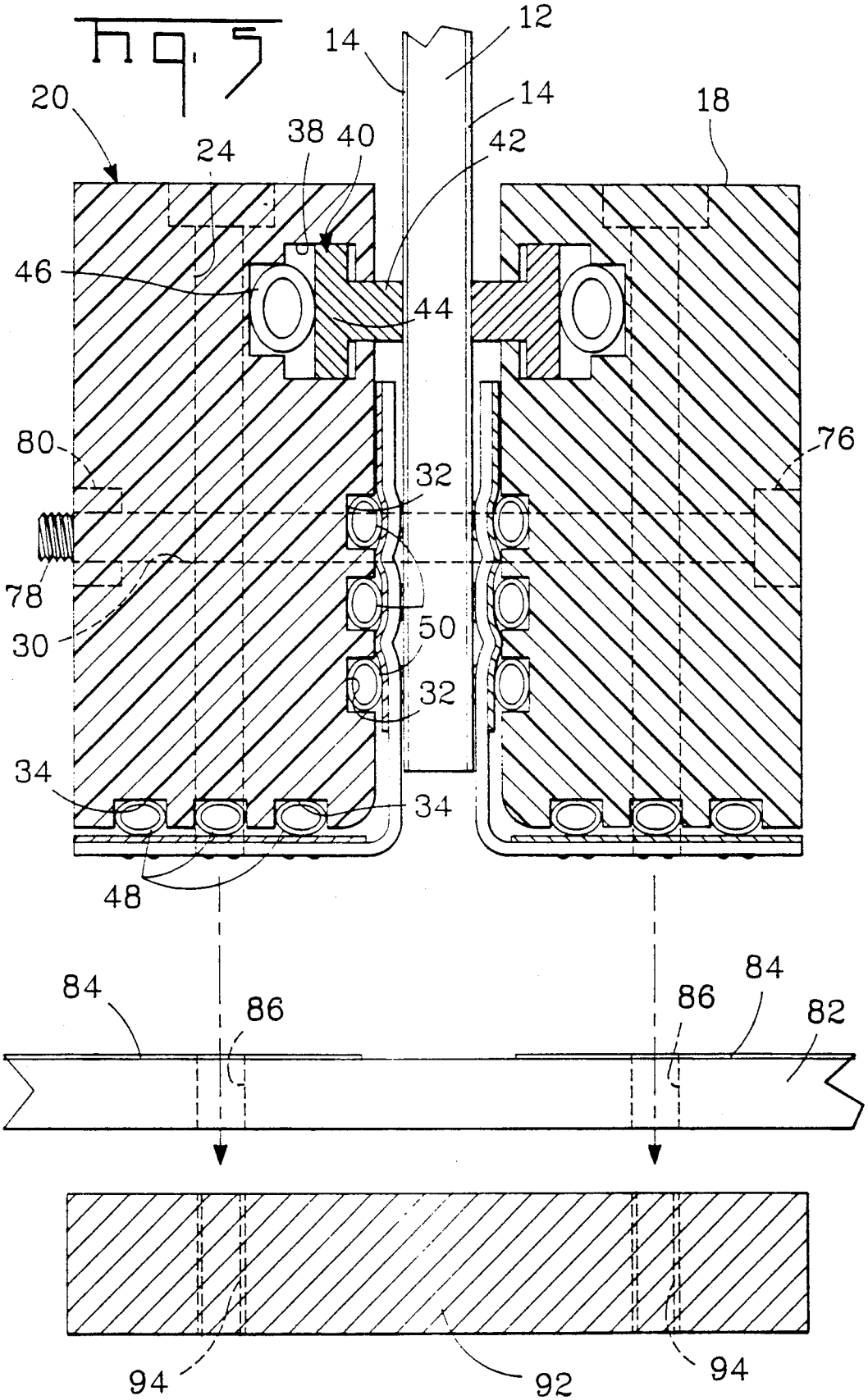
FIG. 5 is a view of the element shown in FIG. 4 following clamping of the connector to the daughter card.
Figure 6:
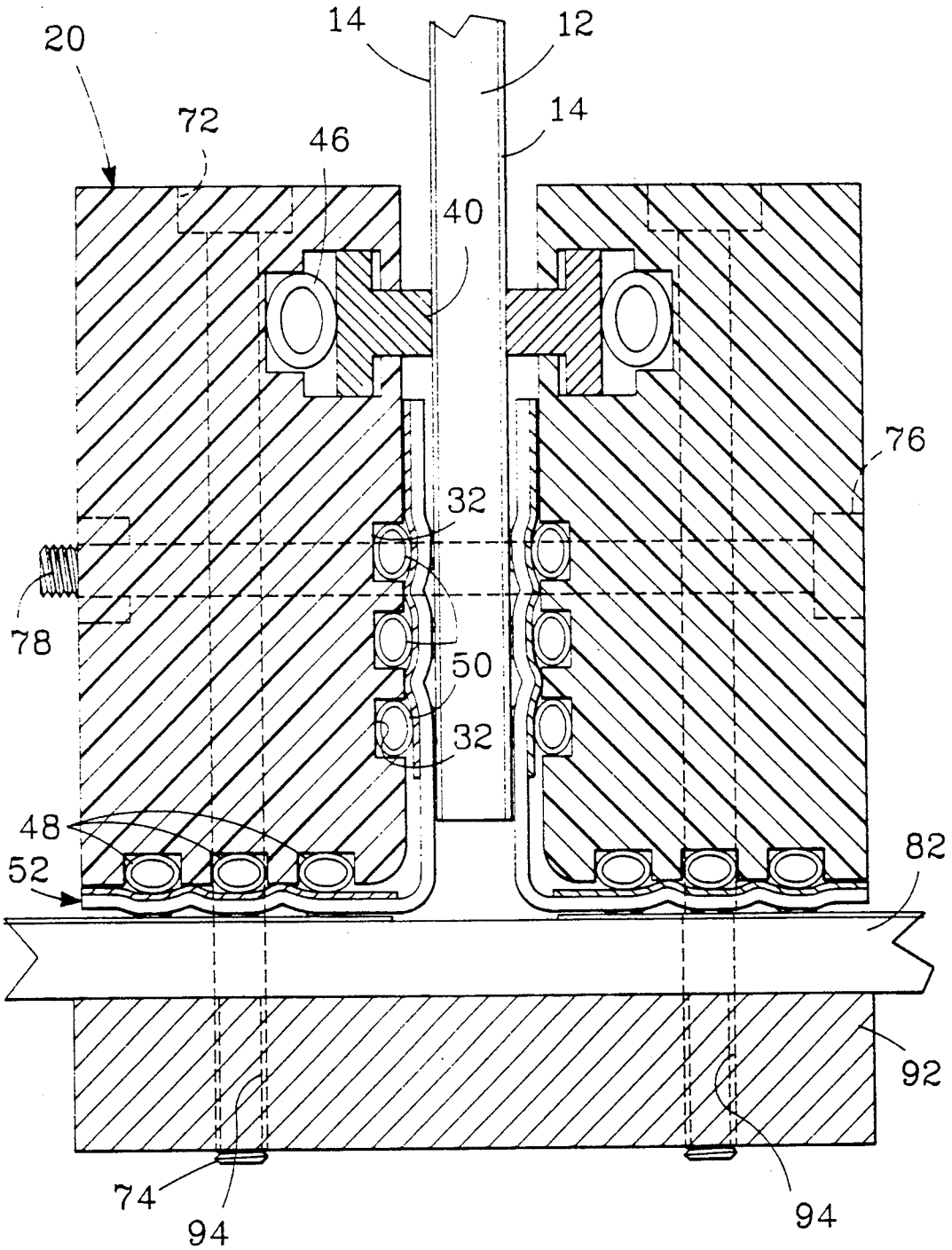
FIG. 6 is a view of the elements shown in FIGS. 4 and 5 following clamping of the connector to the daughter card and to the backpanel.

As can be seen in FIG. 1, the daughter card 12 includes at the ends thereof, a pair of apertures 16 which extend through the card, for purposes to be described. The connector 10 includes a pair of bars 18 and 20 which extend in length along the edge of card 12 and are coextensive with the contact area thereon. Each of the bars is essentially identical and includes a relatively thick and rigid body formed of plastic or metal, by way of example. FIG. 2 shows the bar 20 and the body 22 to include, extending vertically through the bar, apertures 24 and 26 and extending through the sides of the bar, apertures 28 and 30. Also shown in FIG. 2 are a series of grooves 32 on an interior side face of the bar and further grooves 34 extending along the bottom surface of the bar. A further groove 36 is shown to extend along the inner surface of the bar, above from and removed from the grooves 32. As can be seen in FIG. 2 and particularly in FIGS. 3–6, the groove 36 includes an interior 38, substantially enlarged, to receive a clamp 40 which is retained within the groove 36 in a manner to provide limited movement therein. As shown in FIG. 4, the clamp 40 includes a projecting portion 42, and there is provided a spring 46 which drives the clamp inwardly so that the portion 42 engages the daughter card. FIG. 4 also shows the clamp 40 touching the card 12, but prior to the bars being tightly clamped together. FIG. 5 shows the bars 40 driven to clamp and strain relief board 12, the springs 46 driving each of the bars 40 inwardly to effect such clamping. As can be seen in FIG. 2, the portion 42 of the clamp 40 extends essentially across the face of the bar 22 to engage the daughter card, not shown, across its width and provide, through the clamping action, a strain relief to the card, minimizing strains from affecting the interconnection area on the edge of the card as developed by handling of the card during insertion and withdrawal relative to the backpanel. The bars 40 are made of a rigid material, such as plastic or metal, suitably machined to be straight and strong enough to straighten the card 12 upon application in the position shown in FIG. 5.

As can be seen in FIG. 2 and FIGS. 4–6, the connector includes a series of springs 50 which fit into the grooves 32 and extend across the face of the connector and the surface of the daughter card 12. These springs, shown as coil springs, may be of the canted coil variety, a reference being made to U.S. Pat. No. 4,969,824 for a description of canted coil spring structures. It is contemplated that other spring means may be provided to drive contacts in a manner to be described to effect an adequate normal bearing force between contacts being interconnected. FIG. 2 also shows a flat flexible film strip 52 which is comprised of a pair of strips 54 and 58, each apertured at the ends thereof as at 56 and 60. The strip 52 further includes a thin dielectric film 62 which is of a laminar construction, including therewithin conductive paths not shown, but extending to interconnect contacts aligned with the backpanel 82 and with the daughter card 12. FIG. 2 shows the general outline of traces 63 extending transversely to strip 54 to interconnect contacts 70. FIG. 4 shows the strip 52 to include a portion 64 parallel to the backplane and a portion 66 parallel to the daughter card. Contacts 68 are arranged on the surface of the portion 64, and contacts 70 are disposed on the portion 68; both contacts 68 and 70 selectively and individually are interconnected to conductive paths within the lamination of 62. The strips 54 and 58 are preferably of thin copper material which serve to distribute the loads generated by the springs 48, when compressed, and also to provide shielding for the circuits within the lamination 52. As can be appreciated, the strip 52 is flexible and can conform to the lower surface and inner surface of the connector bars. It is to be understood that the strips shown in FIG. 4 relative to bars 18 and 20 would be essentially identical in function.

FIG. 3 shows the daughter card 12 interconnected by the connector 10, preparatory to being installed on the backpanel 82. The backpanel 82 includes a series of conductive paths 84 which are illustrative only of layers of conductive paths in a laminate within 82 and which terminate on the upper surface in the patterns appropriate to an interconnection with the contacts, not shown, on the connector. The backpanel 82 includes holes 86 which receive bolts 72 fitted through the bars 18 and 20 of the connector 10, and additionally, apertures 88, which receive pilot pins 90 extending from beneath the bars 18 and 20. Beneath the backpanel 82 is a further bar 92 which serves to receive the bolts 72 extended therethrough in the manner shown in FIG. 6. The bolts 72 include threaded ends 74 which receive nuts, not shown, suitably tightened to clamp the connector and the daughter board 12 tightly to the upper surface of the backpanel 18. Comparing FIG. 4 to FIG. 5, bolts 76 are first shown extended through the bars 18 and 20 with the threaded ends 78 engaged by nuts 80 preparatory to a clamping of the bars together through the bolts 76. FIG. 5 shows the bars after clamping. In this condition, the contacts of the flexible film strips will have been driven into engagement with the contact paths 14 on card 12. The clamps 42, in each of the bars 18 and 20, will have been driven by springs 46, to clamp, stiffen, and straighten the card 12. Following this clamping action, the assembly, including the connector and card 12, may be positioned with respect to the backpanel, the guide pins 90 entering apertures 88, see FIG. 3, and aligning the connector relative to the contacts thereon and the conductive paths of backpanel 82. Thereafter, the bolts 72 may be inserted through the blocks 18 and 20 and through the apertures 86, further apertures 94 in the bar 92 in the manner shown in FIG. 6. Thereafter, the bolts 72 are operated to clamp the connector 10 and board 12 down onto the surface of backpanel 82. At that juncture, the contacts 68, on the lower surface of strip 52, will have been caused to engage conductive paths 84 and effect an interconnection between the conductive path of the backpanel 82 and the card 12.

Figure 7:
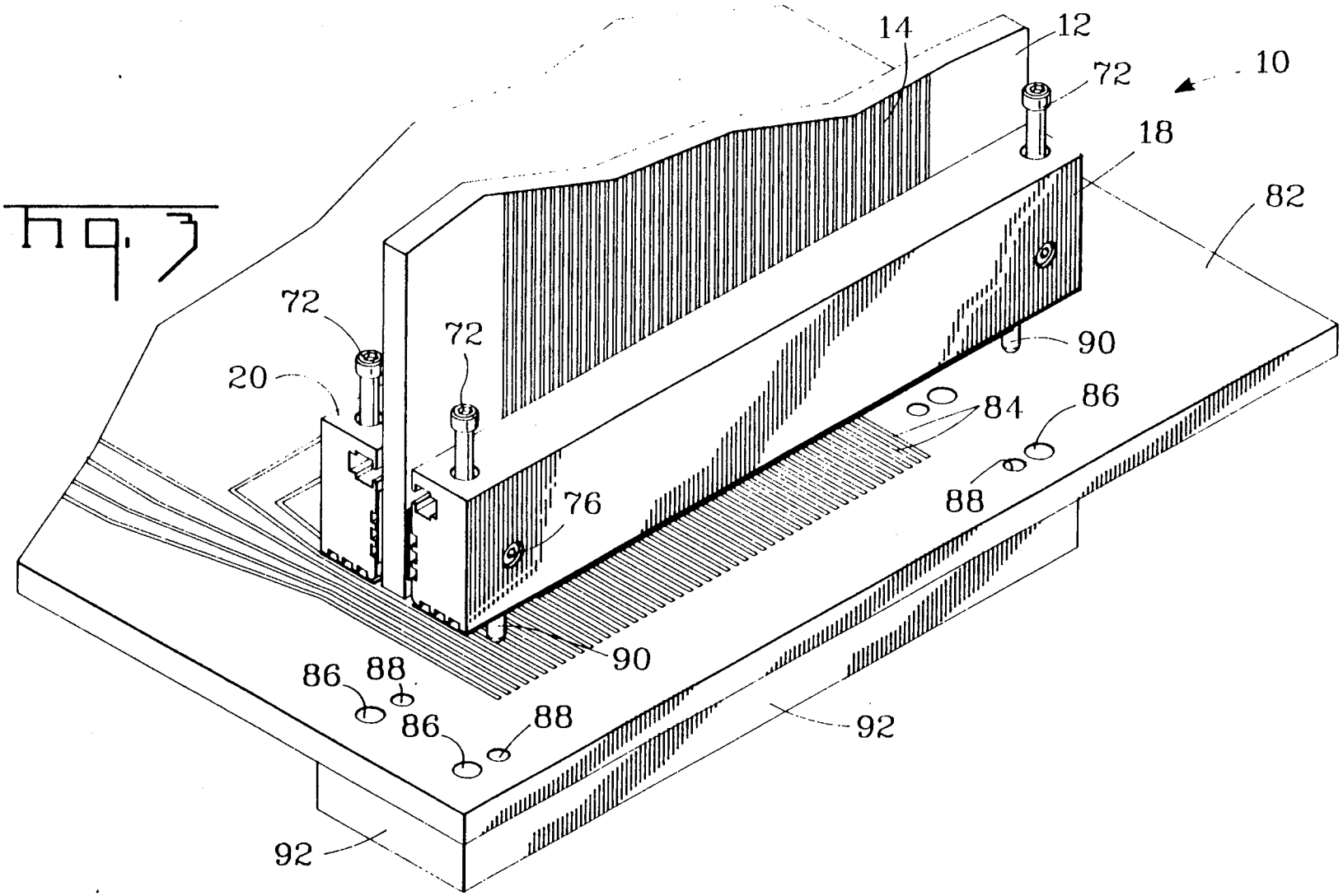
FIG. 7 is a sectional and elevational view, considerably enlarged, showing the interconnection between the flexible circuit of the connector of the invention and the circuit of the backpanel just prior to compression of the contact driving spring.

In accordance with a further aspect of the invention and as shown in FIGS. 7 and 8, the invention contemplates locating two contacts 68 for each conductive path that is to be interconnected. As can be seen, the two contacts 68 are spread apart relative to the point of force development from spring 48, the spring bearing on the sheet 58 as shown. As the bar body 22 is driven down, driving and compressing spring 48, the spring in turn begins to compress and exert a normal force, as shown in FIG. 8, deforming the strip 58, the lamination 64, and driving the contacts 68 to bear against the conductive paths 84 of the backpanel. As can be seen from FIG. 8, the contacts 68 move slightly outwardly as the bending occurs to provide a slight, but effective, wipe of the interfaces clearing corrosion products and debris from the two surfaces to result in a stable, low resistance interconnection between the conductive paths. This wipe will occur each time a daughter card connector is applied or reapplied to the backpanel.

Figure 9:
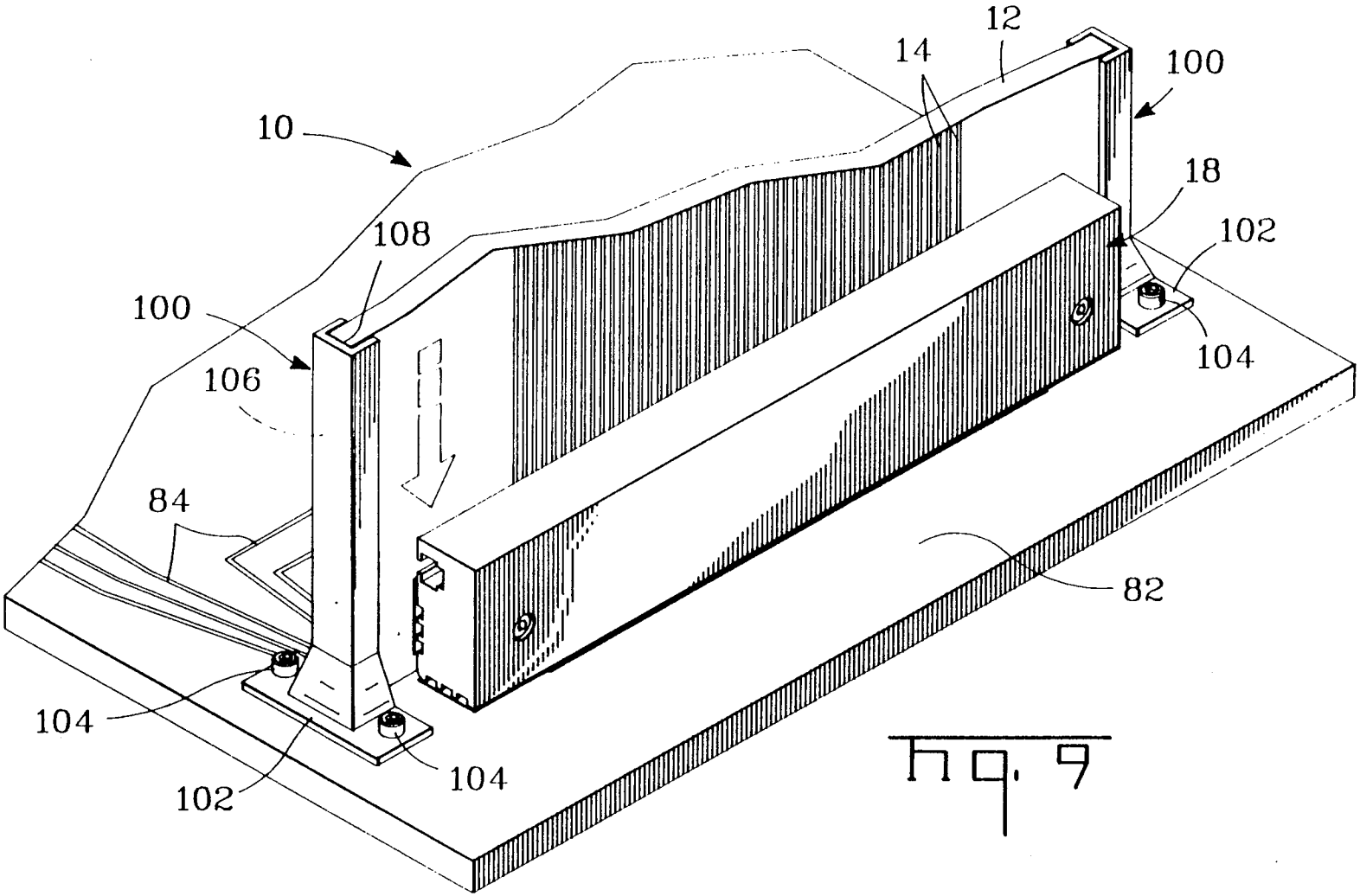
FIG. 9 is a perspective view of the invention in an alternative embodiment, including a daughter card guide structure.

FIG. 9 shows an alternative embodiment wherein the connector 10 includes additionally card guides 100 positioned at each end of the daughter card to receive and guide the daughter card and connector and to support such daughter card along the edges thereof. The guides 100 are preferably of metal and structurally sufficient to support the daughter card 12 against lateral deflection. The guides 100 include feet 102 and bolts 104 which extend through the backpanel 82 and preferably through the bar 92 thereunder to support the guides 100. It is to be understood that the guides 100, including the projections 106 and the interior surfaces 108, would extend up along the edge of the card 12 to provide such support.

In this embodiment, the connector 10 is not bolted to the backplane 82 The compressive force, illustrated by the directional arrow, against the backplane 82, may be achieved by the use of conventional cam locks, not shown, but as known in the art. Typically, such cam locks are pivotal members located at the top of card guides 100 which force the daughter board 12 downward to be compressively held against the backplane 82.

Finally, it will be understood that the concept of this invention may be used in a parallel board stacking arrangement, i.e. daughter board or boards are essentially parallel to the backplane.

We claim:

1. A high density electrical connector for interconnecting conductive paths on close centers between circuit boards, including backpanel and daughter card boards each having circuit paths thereon, comprising a clamping mechanism including rigid bars overlying areas of conductive paths and first means clamping said bars to either side of a daughter card to straighten said card and strain relief the conductive path areas of said card, including in each said bar a first groove extending in said bar in a position overlying said card and including a first spring and a rigid clamp driven thereby engaging said card on either side, said bars including further grooves containing contact driving springs extending in said bars in a position overlying said card and said backpanel and a thin flat flexible circuit having contacts exposed on the surface thereof in patterns complementary to the circuit paths of the backpanel and daughter card with said contacts being disposed proximate said contact driving springs, the said first means clamping said bars driving the said contact driving springs against the said circuit to drive the said contacts against the circuit paths to effect an intermating between surfaces thereof.

2. The connector of claim 1 including a clamping plate positioned under the backpanel and further means extending through the backpanel board and through the said plate to clamp said contact driving springs against the flexible circuit driving the contacts thereof against the said circuit paths of the backpanel board to interconnect such paths to the circuit paths of the daughter card.

3. The connector of claim 1 wherein the said first means includes bolts passing through the said card and rigid bars with means to draw the said bars together against said card.

4. The connector of claim 1 wherein the said contacts of the said circuit are arranged in pairs in the said circuit with the said contact driving springs oriented to engage the said circuit along an axis between a pair of said contacts to drive the said contacts in a normal direction for effecting said interconnection to provide a slight wipe of the intermating surfaces.

5. The connector of claim 1 wherein each said bar includes rows of said further grooves containing said contact driving springs on one side thereof to engage the circuit adjacent said card and said first groove is adjacent the rows of grooves and inboard thereof carrying the first spring driving said clamp at right angles to the sides of the daughter card to provide a strain relief.

6. The connector of claim 5 wherein the said first groove includes a means to limit the movement of said clamp against the said card.

7. The connector of claim 1 wherein the said contact driving springs extend along the length of said bars in a position to develop forces at right angles to the length of said bars being engaged thereby to generate normal contact forces sufficient to effect a stable, low- resistance electrical interface.

8. The connector of claim 1 wherein the said first springs and said contact driving springs are canted coil springs extending along the length of the said bars.

9. The connector of claim 1 wherein the said card and backpanel and the said circuit include holes therein and the said rigid bars include holes complementary thereto and bolt means extend through the holes in said card, backpanel and circuit with means to clamp the said circuit and card and backpanel together to effect an interconnection thereof.

10. The connector of claim 1 wherein said contacts on the flat flexible circuit consist of a pair of spaced-apart dimples offset from the center of a respective said contact driving spring.

11. The connector of claim 10 wherein said contacts are flexibly mounted to move away from one another to effect a contact wipe of the intermating surfaces.

* * * * *